US005755578A

United States Patent [19]

Contant et al.

[11] Patent Number: 5,755,578

[45] Date of Patent: May 26, 1998

[54] VACUUM-CLEANER-HOSE ASSEMBLY HAVING A SWIVEL BEND AND VACUUM CLEANER HAVING SUCH ASSEMBLY

[75] Inventors: Cornelis J. Contant; Wiebe Wierda, both of Hoogeveen, Netherlands

[73] Assignee: U.S. Philips Corporation, New York, N.Y.

[21] Appl. No.: 739,772

[22] Filed: Oct. 30, 1996

[30] Foreign Application Priority Data

Oct. 30, 1995 [EP] European Pat. Off. ..... 952022925

[51] Int. Cl.[6] ..... H01R 39/00

[52] U.S. Cl. ..... 439/23; 439/191; 15/339; 15/327.7; 15/377; 285/7

[58] Field of Search ..... 15/327.1, 327.7, 15/339, 377; 285/7, 179, 275, 272; 439/191–195, 23–26

[56] References Cited

U.S. PATENT DOCUMENTS 4,557,535 12/1985 Keane ..... 439/192

5,472,346 12/1995 Gray et al. ..... 439/23

FOREIGN PATENT DOCUMENTS 0307735 3/1989 European Pat. Off. .

*Primary Examiner*—Gary F. Paumen

[57] ABSTRACT

A vacuum-cleaner-hose assembly includes a vacuum-cleaner hose (6, 36) and a swivel coupling (3, 33) for coupling the vacuum-cleaner hose (6, 36) to a housing (4) of a vacuum cleaner so as to allow it to be swivelled about a swivel axis (5) and at an angle relative to said swivel axis (5). The swivel coupling (3, 33) has a hose guide (8, 38) which surrounds a flexible portion (24, 54) of the vacuum-cleaner hose (6, 36) and holds said portion of the vacuum-cleaner hose (6, 36) in a curved position. Since the vacuum-cleaner hose is held in a curved position, the connection of the vacuum-cleaner hose to the swivel coupling can be arranged closer to that end of the swivel coupling which is to be connected to the vacuum cleaner, as a result of which the swivel coupling can be smaller and the swivel coupling or at least a combination of the swivel coupling and an adjoining coupling portion of the vacuum-cleaner hose projects less far in relation to the swivel axis of the swivel coupling.

19 Claims, 5 Drawing Sheets

VACUUM-CLEANER-HOSE ASSEMBLY HAVING A SWIVEL BEND AND VACUUM CLEANER HAVING SUCH ASSEMBLY

BACKGROUND OF THE INVENTION

1. Field of the Invention

The invention relates to a vacuum-cleaner-hose assembly having a vacuum-cleaner hose and a swivel coupling for coupling the vacuum-cleaner hose to a housing of a vacuum cleaner so as to allow swivelling about a swivel axis and at an angle relative to the swivel axis. An air channel extends through the vacuum-cleaner hose and the swivel coupling.

The invention also relates to a vacuum cleaner having vacuum-cleaner-hose assembly which includes a vacuum-cleaner hose and a swivel coupling by which the vacuum-cleaner-hose assembly can be coupled to a housing of the vacuum cleaner. This allows it to be swivelled about a swivel axis and at an angle relative to the swivel axis. On air channel extends through the vacuum-cleaner hose and the swivel coupling.

2. Description of the Related Art

Such a vacuum-cleaner-hose assembly and such a vacuum cleaner are known from European Patent Specification 0,307,735, the swivel coupling having one end adapted to be coupled to the housing of a vacuum cleaner so as to allow bodily rotation of the coupling. The other end of the swivel coupling is coupled to the vacuum-cleaner hose.

A disadvantage of this construction is that the swivel coupling is comparatively large and projects far from the vacuum cleaner, as a result of which a comparatively large clearance is required for the passage underneath furniture and the like. Moreover, the comparatively large swivel coupling forms a cumbersome element which detracts from the appearance of the vacuum cleaner or at least from the design freedom of the designer. If a smaller swivel coupling were available, this would also be advantageous for reasons of distribution and packaging.

In addition, the swivel coupling and a rigid portion of a hose connected to the swivel coupling project far in relation to the swivel axis. As a result, a large torque is exerted on the connection of the swivel coupling when a force which is directed substantially parallel to the swivel axis is exerted on the rigid portion of the hose connected to the coupling. This occurs frequently in practice, for example when the vacuum cleaner gets stuck underneath a piece of furniture, when someone accidentally steps onto the vacuum cleaner, when the vacuum cleaner topples over from an upended position, and when the vacuum cleaner is lifted by its hose, for example to pull it across a threshold.

SUMMERY OF THE INVENTION

It is an object of the invention to provide a vacuum-cleaner-hose assembly in which the swivel coupling and, if applicable, a non-flexible coupling portion of the vacuum-cleaner hose, which portion adjoins the swivel coupling, can be of a more compact construction and the swivel coupling is loaded less severely when subjected to forces which are directed substantially parallel to the swivel axis.

To this end, a vacuum-cleaner-hose assembly in accordance with the invention is characterized in that the swivel coupling comprises a hose guide which surrounds a flexible portion of the vacuum-cleaner hose and holds said portion of the vacuum-cleaner hose in a curved position.

To this end, a vacuum cleaner in accordance with the invention is characterized in that the vacuum cleaner comprises a vacuum-cleaner-hose assembly in accordance with the invention.

Since the vacuum-cleaner hose is held in a curved position, the connection of the vacuum-cleaner hose to the swivel coupling can be arranged closer to that end of the swivel coupling which is to be connected to the vacuum cleaner, as a result of which the swivel coupling, if applicable in combination with an adjoining coupling portion of the vacuum-cleaner hose, can be smaller and the swivel coupling or at least said combination projects less far in relation to the swivel axis of the swivel coupling.

Since bending of the curved portion of the hose during use is limited by the hose guide, the life of this curved portion is extended. As the possibility of following swivelling movements of the hose by swivelling movements of the rotatable coupling part is maintained, the maneuverability of the hose is not adversely affected and, in principle, the hose is bent back and forth not more frequently than in the case of the afore-mentioned known vacuum-cleaner-hose assembly.

Special embodiments of the present invention have been defined in the subsidiary claims.

BRIEF DESCRIPTION OF THE DRAWING

Hereinafter, the invention will be described in more detail and will be elucidated on the basis of some embodiments with reference to the drawings. In the drawings.

DESCRIPTION OF THE PREFERRED EMBODIMENTS

Figure 1:
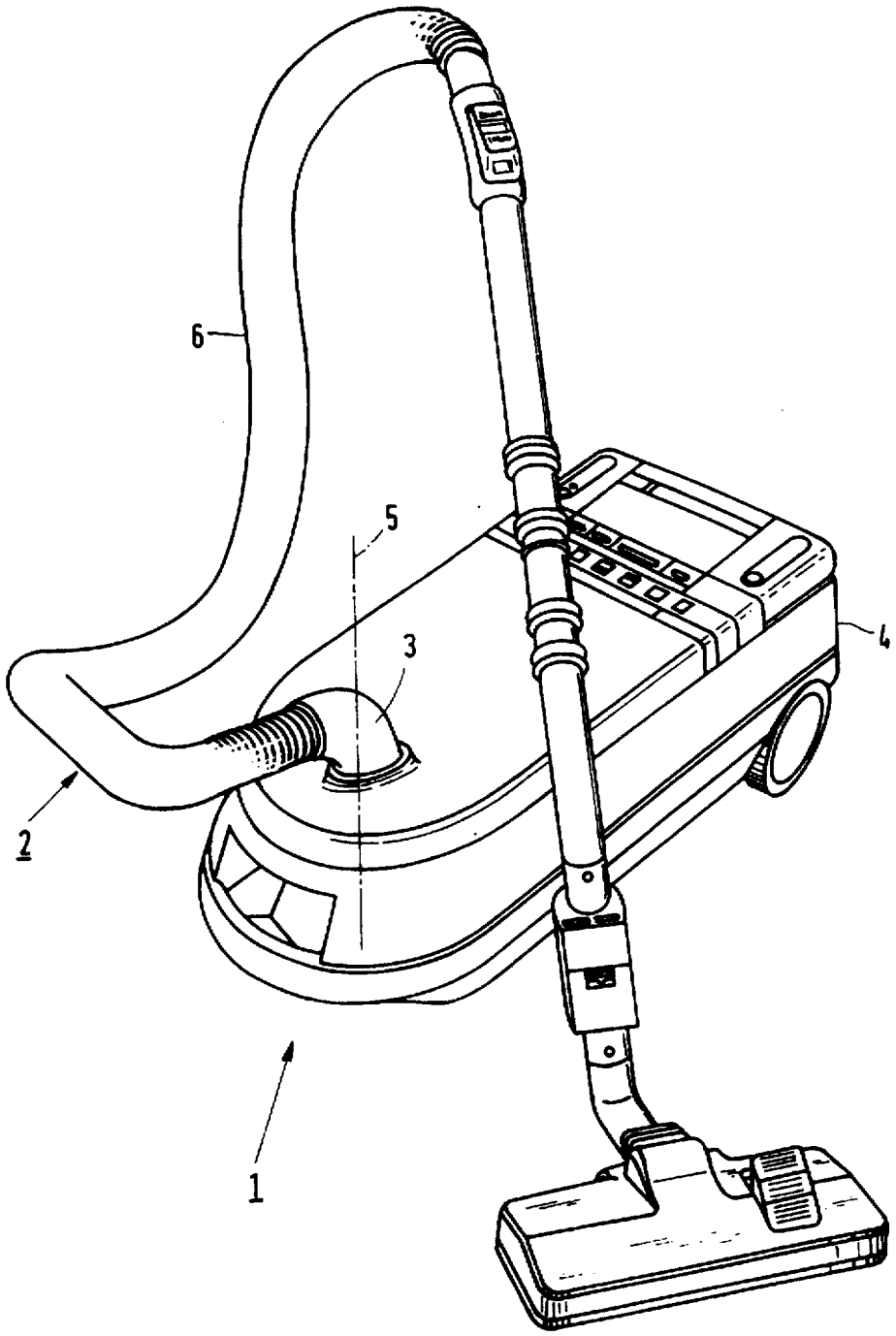
FIG. 1 is a perspective view of a vacuum cleaner with a vacuum-cleaner-hose assembly in accordance with the invention.

The vacuum cleaner 1 shown in FIG. 1 is based on a commercially available vacuum cleaner in this example Philips TC 898, but equipped with a vacuum-cleaner-hose assembly 2 in accordance with the invention, which includes a hose 6 and a modified swivel coupling 3. The housing 4 of the vacuum cleaner has been modified accordingly. The vacuum-cleaner-hose assembly 2 projects radially relative to an imaginary axis 5 about which the swivel coupling can swivel. As is known per se, this results in a high maneuverability of the suction hose 6. Moreover, bending of the suction hose 6 during use is limited owing to the swivel capability of the swivel coupling 3 and the angle at which the hose 6 extends relative to the swivel axis.

Figure 2:
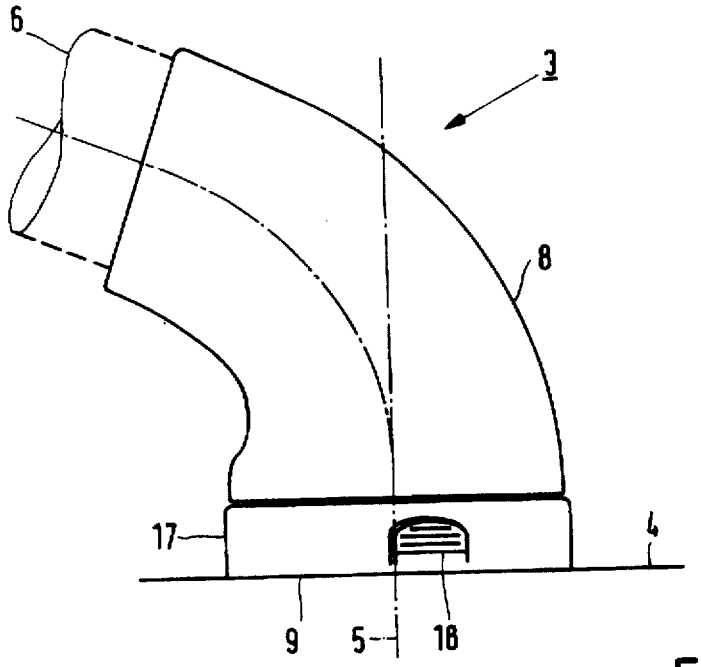
FIG. 2 is a side view of a vacuum-cleaner-hose assembly in accordance with an embodiment of the invention and of a part of a housing of a vacuum cleaner, which part adjoins the swivel coupling.
Figure 4:
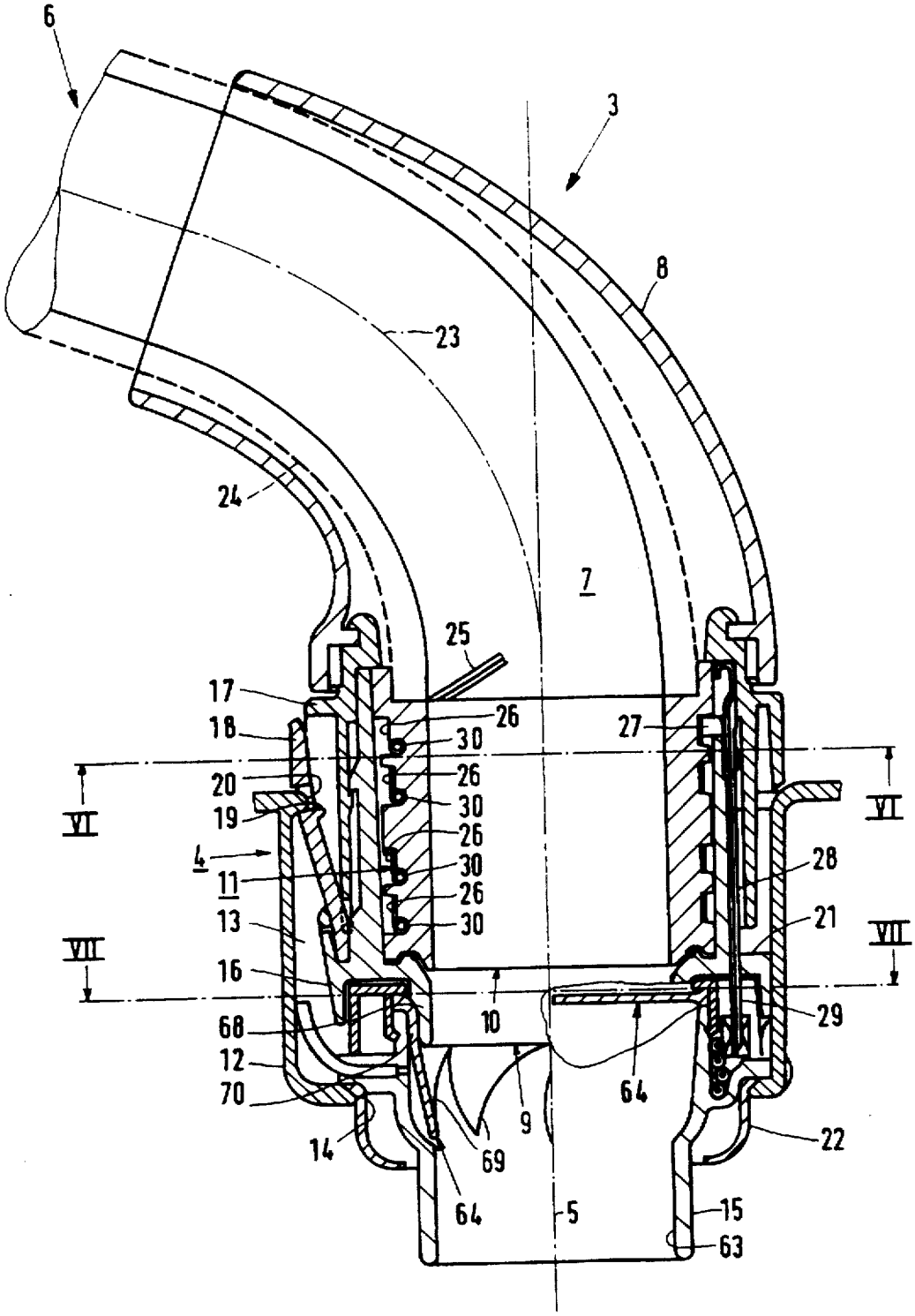
FIG. 4 shows the vacuum-cleaner-hose assembly of FIG. 2 in a sectional view taken on the line IV—IV in FIG. 6.
Figure 6:
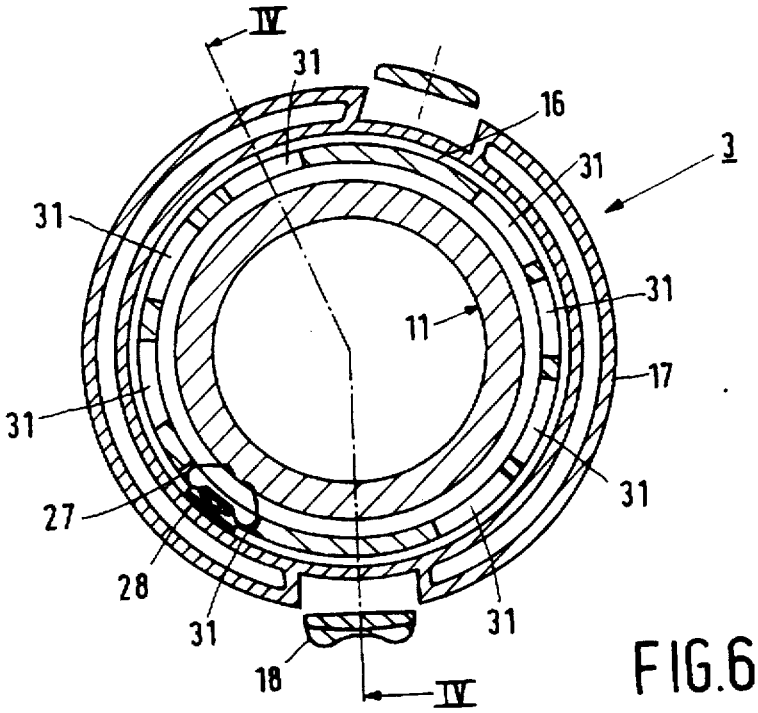
FIG. 6 is a sectional underneath view taken on the line VI—VI in FIG. 4.

The vacuum-cleaner-hose assembly of the vacuum cleaner in the present embodiment of the invention is shown in greater detail In FIGS. 2, 4 and 6, of which FIGS. 2 and 4 diagrammatically show only a part of the hose 6, for which generally available customary types of vacuum-cleaner hose can be used.

Thus, in the present embodiment the vacuum-cleaner-hose assembly 2 comprises a vacuum-cleaner hose 6 and a swivel coupling 3 for coupling the vacuum-cleaner hose 6 to the housing 4 of a vacuum cleaner so as to allow swivelling about a swivel axis 5 and at an angle relative to this swivel axis 5. Air and dust carried thereby can be drawn into the vacuum cleaner 1 through an air channel 7, which extends via the vacuum-cleaner hose 6 nd the coupling 3.

The shown part of the housing 4 of the vacuum cleaner is constructed as a socket 12 which bounds a recess 13. In an opening 14 in a bottom portion of the socket 12, a coupling sleeve 15 is mounted, to which the swivel coupling 3 is connected in a sealed manner in the operating condition shown. A seal 22 is interposed between the socket 12 and the coupling sleeve 15.

The swivel coupling 3 comprises a part which is non-rotatable relative to the housing 4 of the vacuum cleaner in the mounted condition and which comprises an inner bush 16 and an outer bush 17, which are locked relative to one another by means of projections. A latching arm 18 is interposed between the inner bush 16 and the outer bush 17 and can be pivoted towards the bushes from a released condition. When the swivel coupling 3 has been mounted and the latching arm is released, a latching surface 19 of the latching arm 18 engages behind a latching projection 20, which projects from the socket 12. Diametrically opposite the latching arm 20 the inner bush 16 has a nose 21, which engages against a wall portion of the socket 12, which wall portion extends substantially parallel to the swivel axis 5. When the swivel coupling 3 is subjected to a force which is directed away from the housing 4, the coupling being retained by the latching arm 19 which engages against the projection 20, the swivel coupling 3 tends to pivot about the projection 20. This is precluded by the nose 21.

By pressing down an end portion of the latching arm 18 the latching surface 19 is disengaged from the projection 20, as a result of which the swivel coupling is released and can be pulled off the housing 4.

The swivel coupling 3 comprises a hose guide 8, which surrounds a part of the vacuum-cleaner hose 6 and holds this part of the vacuum-cleaner hose 6 in a curved position. The hose guide 8 is rotatably mounted on the outer bush 17 of the swivel coupling 3 and constitutes one of the parts of the swivel coupling 3 which are rotatable relative to the housing 4 of the vacuum cleaner.

Since the vacuum-cleaner hose 6 is held in a curved position, the connection of the vacuum-cleaner hose 6 to the swivel coupling 3 can be arranged closer to that end 9 of the swivel coupling 3 which is to be coupled to the vacuum-cleaner housing 4. The swivel coupling 3, in combination or not in combination with an adjoining coupling portion of the vacuum-cleaner hose 6, can thus be of a compact construction, as a result of which the swivel coupling 3, or at least said combination, only projects over a small distance relative to the swivel axis 5 of the swivel coupling 3.

Since the hose guide limits bending of the curved portion of the hose 6, this curved portion of the hose 6 has a long life, despite its curved condition. The possibility of following swivelling movements of the hose 6 during operation by swivelling movements of the rotatable coupling part is maintained, as a result of which the maneuverability of the hose 6 is not adversely affected and, in principle, the hose 6 is bent back and forth not more frequently than in the case of known vacuum-cleaner-hose assemblies.

At the side of the swivel coupling 3 the vacuum-cleaner hose 6 has an end 10 which is coaxial with the swivel axis 5, which in the construction in accordance with the present example is constituted by an end of a hose spigot 11 which forms part of the hose 6.

The end 10 of the hose 6 has been formed so as to be coaxial with the swivel axis 5. This has the advantage that this end can also serve as an end of the rotatable coupling part of the swivel coupling. This, in its turn, has the advantage that the connection of the hose 6 to the swivel coupling 3 also forms the connection of the rotatable portion of the swivel coupling 3 to the fixed portion of the swivel coupling 3, which saves a joint to be sealed. Even if the swivel coupling is bodily rotatable relative to the housing the joint to be sealed between the hose and the swivel coupling can be dispensed with. In that case a seal between the end of the hose and the inlet of the vacuum cleaner can suffice.

As described hereinbefore, the swivel coupling 3 in accordance with the present example comprises a hose-side first coupling part formed by the hose guide 8 and the hose 6 and a second coupling part formed by the inner and outer bushes 16, 17, the first coupling part being rotatable relative to the second coupling part about the swivel axis 5 and the second coupling part being adapted to be coupled to a vacuum-cleaner housing 4. In this way it is achieved that each time that the vacuum-cleaner-hose assembly 2 is detached, the swivel coupling 3 is not separated at the location of the joint between parts which are rotatable relative to one another but at the location of parts to be coupled to one another in each time the same position. As a result, seals between parts which are rotatable relative to one another are not repeatedly exposed to soiling and the risk of damage. The seals between parts to be coupled to one another in each time the same position can be of a simple and robust construction and generally do not require lubrication because the only relative movement between the mutually sealed parts occurs during assembling and disassembling of the relevant coupling parts.

In the vacuum-cleaner-hose assembly in accordance with the present example the vacuum-cleaner hose 6 is, moreover, rotatable about its longitudinal axis 23 inside the hose guide 8. The vacuum-cleaner hose 6 can rotate in the hose guide 8 like a flexible shaft. This has the advantage that torsional stresses in the hose 6 are avoided and that the hose 6 can readily adjust to the movements desired during use. The rotatability of the hose 6 is obtained without an additional rotary joint to be sealed in that the end 10 of the hose 6 also forms the end to be sealed of the rotatable coupling part. No sealing is required between the hose guide 8, which is rotatable independently of the rotation of the hose 6 about its longitudinal axis 23 and the fixed coupling part, because this rotatable joint is situated outside the hose 6.

Since the vacuum-cleaner hose 6 comprises a flexible portion 24 and the hose spigot 11 adjoining the flexible portion at the side of the swivel coupling, and the joint between the flexible portion 23 of the hose 6 and the hose spigot 11 is oriented coaxially with the swivel axis 5, a uniform rotatability of the vacuum-cleaner hose 6 about its longitudinal axis 23 is obtained over one full revolution.

Conversely, if the flexible hose portion would adjoin the hose spigot at an angle relative to the swivel axis, the hose would each time tend to resume a certain preferential position. The hose is then bent less intensively during use than when it is rotatable with a uniform resistance over one full revolution inside the hose guide 8.

The flexible portion 24 of the vacuum-cleaner hose 6 has been provided with a bundle of electrical conductors, represented diagrammatically at 25. The hose spigot 11 which directly adjoins the flexible portion 24 at the side of the swivel coupling 3 has been provided with slip rings 26 connected to the electrical conductors. The electrical conductors are arranged as separate conductors 30 in the hose spigot 11. This yields a very efficient construction, in which the hose spigot 11 of the vacuum-cleaner hose 6 also serves as a support for the slip rings 26 and which allows then use of very short conductors between the flexible portion 24 of the hose 6 and the slip rings 26. Moreover, as a result of the direct mounting of the slip rings on the hose spigot 11 of the vacuum-cleaner hose, no ducts or recesses are needed for conductors between the vacuum-cleaner hose and the slip rings.

It is to be noted that the same advantages can be obtained when the hose spigot is provided with wiper contacts instead of slip rings. The number of slip rings or wiper contacts obviously depends on the envisaged use. If the swivel coupling has been made of a conductive material one slip ring would be adequate in certain cases, the ground connection being formed then by the body of the swivel coupling. However, generally the swivel coupling will have been made of a plastics, so that also a slip ring for at least one ground connection will be required.

As already stated, the hose spigot 11 forms part of the hose-side first coupling part. The second coupling part further comprises wiper contacts and conductors connected to these contacts. FIG. 4 shows one of these wiper contacts 27 and one of these conductors 28. For the sake of clarity FIG. 6 shows only one conductor 28 and one wiper contact 27.

In combination with means for the transmission of electricity a further advantage of a second coupling part, which in its coupled condition is coupled to the vacuum cleaner in a fixed non-rotatable position, is that for the electrical connection between the swivel coupling 3 and the vacuum-cleaner housing 4 contact pins and contact springs can be used and no slip rings and wiper contacts are necessary, which are more difficult to shield in the uncoupled condition and, consequently, for safety reasons are generally less suitable for transferring mains voltage.

Moreover, the contact pins and contact springs of the electrical coupling between the second coupling part and the vacuum cleaner occupy considerably less space than disconnectable slip rings and wiper contacts and are less susceptible to damage and soiling.

A further advantage of the presence of a second coupling part to be coupled to the vacuum cleaner in a fixed position is that the swivel coupling can be coupled simply because the second coupling part should always be inserted in the same position.

Furthermore, in the case of the swivel coupling 3 in accordance with the present example the connection between contact pins 29 of the second coupling part and the slip rings 26 of the first coupling part is obtained in a particularly simple manner in that the contact pins 29 each have an arm 28 which extends up to a location opposite a contact face of the slip rings 26. Thus, the connection between the contact pins 29 and the slip rings 26 can be obtained very simply.

In the case of the swivel coupling 3 in accordance with the present example the connection between the arms 28 of the contact pins 29 and the slip rings 26 is obtained in a very simple manner in that the wiper contacts 27 each project from the conductive arms 28, which are directed transversely to the slip rings 26, towards the relevant slip ring 26.

The wiper contacts may be constructed as arm portions which project towards the relevant slip rings and which extend along the slip rings. However, a preferred construction is shown in FIGS. 4 and 6, where the wiper contacts 27 have each been arranged on one of said arms 28 in a position corresponding to the position of the respective slip ring 26, the arms 28 being identical to one another. Thus, by suitably positioning the wiper contacts, each arm 28 can be brought into contact with a given slip ring 26 by means of a limited variety of parts. Although in the present example the arms 28 take the form of extensions of the contact pins 29, the desired connection between a respective arm which extends transversely to the slip ring and a given slip ring can also be obtained if the arms do not form extensions of a contact pin or contact spring but have been connected to further conductors in another manner.

The slip rings 26 and the contact pins have each been mounted in a recess at a corresponding mounting position. As is shown clearly in FIG. 6, eight positions 31 have been provided for contact pins 29 or at least the arm-shaped extensions 28 of these pins. As is apparent particularly from FIG. 4, the hose spigot 11 has been provided with four recesses for slip rings 26.

Since the number of mounting positions 31 adapted to receive contact pins 29 is larger than the number of mounting positions for slip rings 26, it is possible to reserve for each position of a contact pin a specific vacuum-cleaner-hose function, such as remote suction-power control, or the power supply for driving brushes in the vacuum-cleaner nozzle. Since a give position has been provided for each function, a certain vacuum-cleaner-hose assembly, in versions which differ only as regards their electrical configuration, can be used in conjunction with vacuum cleaners having provisions for different vacuum-cleaner-hose functions, without damage or hazardous situations arising if inadvertently a vacuum-cleaner-hose assembly adapted to cooperate with a given type of vacuum cleaner is coupled to another type of vacuum cleaner. For example, if the vacuum cleaner is adapted to perform a given function but the vacuum-cleaner-hose assembly coupled to it is not adapted to perform this function, damage and hazardous situations are precluded in that the vacuum-cleaner-hose assembly has not been provided with a contact pin or contact pins at the position or the positions reserved for the relevant function and, as a result, simply no contact is made with the contact springs of the vacuum cleaner at the positions corresponding to this function. If the vacuum cleaner is not adapted to perform a given vacuum-cleaner-hose function whereas the coupled vacuum-cleaner-hose assembly is adapted to perform this function, damage and hazardous situations are precluded because in this case the relevant contact-pin of the vacuum-cleaner-hose assembly cannot become live. Particularly, owing to the contactpin and contact-spring positions reserved for specific functions, electrical circuits of the vacuum-cleaner-hose assembly which have been designed for low-voltage operation (for example a circuit for remote suction-power control) cannot be connected to connection points of the vacuum cleaner to which mains voltage is applied (generally approximately 110 V or 20 to 240 V). Connection points to which mains voltage is applied are, for example, connection points connected to the power supply for an electric motor for driving brushes in the nozzle.

Figure 3:
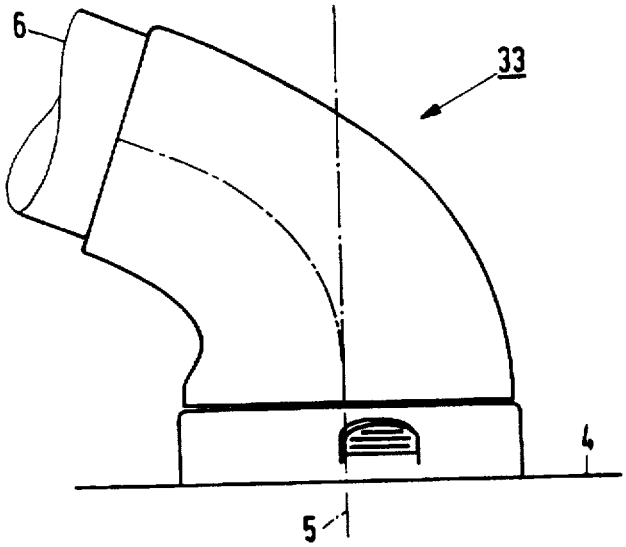
FIG. 3 shows a vacuum-cleaner-hose assembly in accordance with another embodiment of the invention in a view similar to that of FIG. 2.
Figure 5:
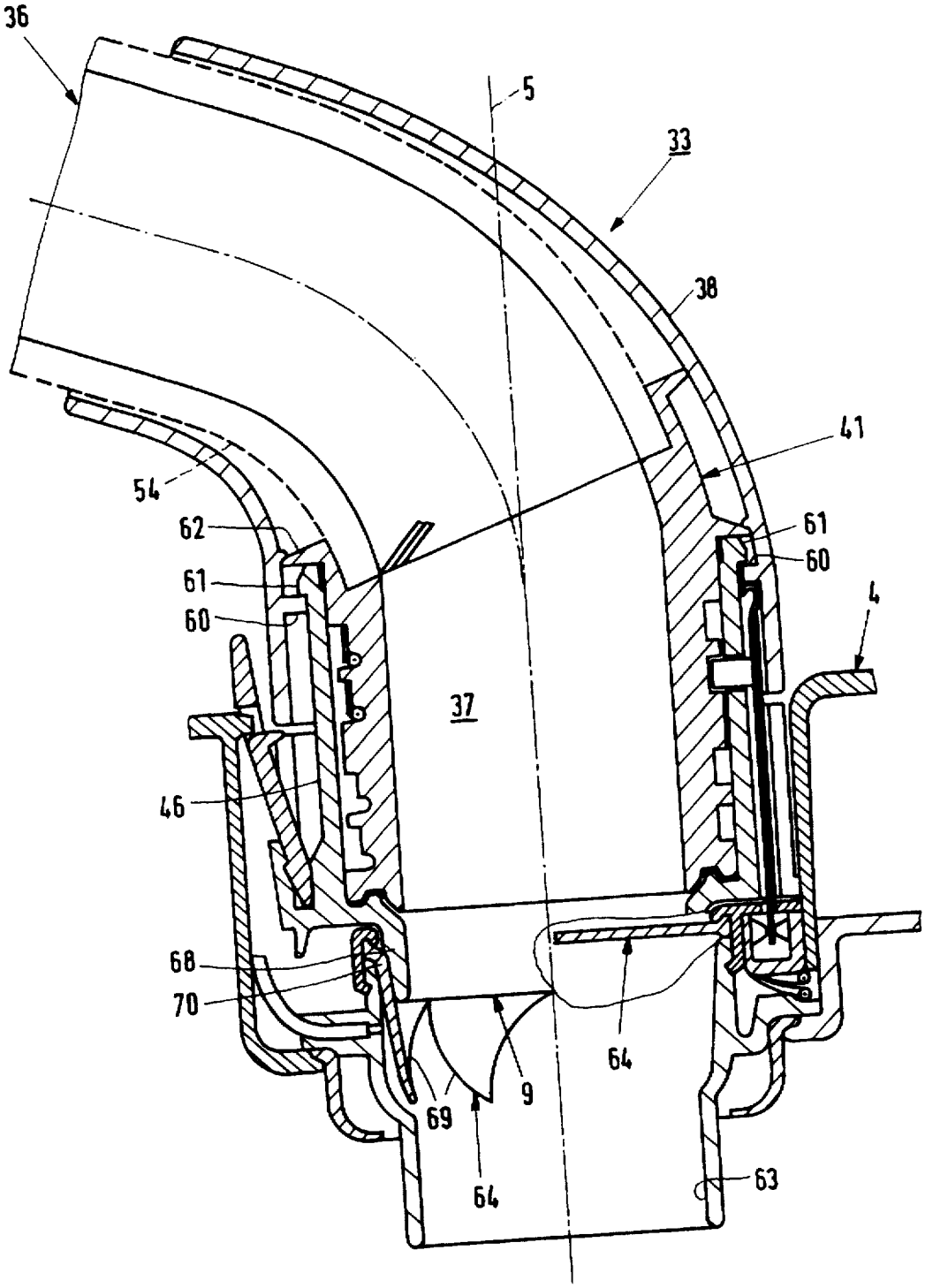
FIG. 5 shows the vacuum-cleaner-hose assembly of FIG. 3 in a view similar to that of FIG. 4.

FIGS. 3 and 5 show the swivel coupling 33 and an adjoining portion of vacuum-cleaner hose 36 of a vacuum-cleaner-hose assembly in another embodiment of the invention. These Figures further show a part of the vacuum-cleaner housing 4. The vacuum-cleaner hose 36 comprises inter alia a flexible portion 54 and a hose spigot 41 connected to the flexible portion 54 at the side of the swivel coupling 33. In the same way as in the vacuum-cleaner-hose assembly described hereinbefore, the air channel 37 for the intake of air takes the form of a bend in the swivel coupling 33, which extends partly in the hose spigot 41 and partly in the flexible portion 54 of the vacuum-cleaner hose 36, which portion is held in a curved condition.

Since the bend in the air channel 37 extends partly in the hose spigot 41 the air channel 37 can already deflect in the hose spigot 41 relative to the part of the air channel 37 which is coaxial with the swivel axis 5, which results in an even more compact swivel coupling 33.

The vacuum-cleaner-hose assembly shown in FIGS. 3 and 5 has been simplified further as compared with the vacuum-cleaner-hose assembly described hereinbefore, in that the coupling part which is non-rotatable relative to the housing 4 in the coupled condition does not comprise an inner bush 16 and an outer bush 17 but comprises a single bush 46. The hose guide 38 has a circumferential rim 60 which engages behind projections 61 of the bush 46. Said projections 61 of the bush 46 have tapered run-on surfaces, so that the hose guide 38 can readily be snapped onto the bush 46.

In the mounted condition the hose guide 38 is rotatable relative to the bush 46 and also holds the hose spigot 41 in the correct position in the bush 46 by means of a circumferential rim 62 which engages with the hose spigot 41. Since the hose spigot 41 extends into a part of the hose guide 38 which is curved relative to the swivel axis 5, the hose spigot 41, when possible play is ignored, can only be swivelled together with the hose guide relative to the bush 46.

The arrangement and construction of the electrical conductors and contacts of the vacuum-cleaner-hose assembly as shown in FIGS. 3 and 5 is basically identical to the arrangement and construction of these parts in the embodiment as shown in FIGS. 2, 4 and 6.

Figure 7:
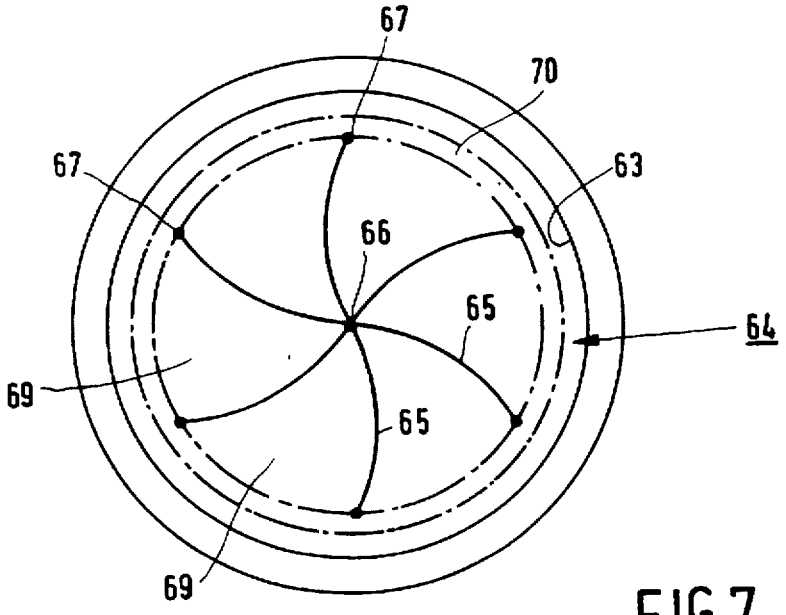
FIG. 7 is a diagrammatic plan view taken on the line VII—VII in FIG. 4.

FIG. 7 diagrammatically shows the inlet duct 63 in the vacuum cleaner in plan view. FIGS. 4 and 5 show the inlet duct 63 in sectional view in combination with vacuum-cleaner-hose assemblies described hereinbefore and coupled thereto. A sealing diaphragm 64 arranged in the inlet duct 63 serves for at least for the greater part closing the inlet duct 63 when the vacuum-cleaner-hose assembly has been removed from the vacuum cleaner and for opening the inlet duct 63 when the vacuum-cleaner-hose assembly has been coupled to the vacuum-cleaner housing 4. FIGS. 4 and 5 have inset portions which each show a part of the inlet duct 63 in which the sealing diaphragm 64 is disposed when the vacuum-cleaner-hose assembly has been removed and a part of the sealing diaphragm 64 is consequently in a closed position. FIG. 7 also shows the sealing diaphragm 64 in the closed position. FIGS. 3 and 4 also show a part of the sealing diaphragm 64 in the open position.

The sealing diaphragm 64 has cuts 65 which, when the vacuum-cleaner-hose assembly has been removed, each extend from a central area 66 of the diaphragm to a point near the wall of the inlet duct 63 and whose outer ends 67 are equispaced in the circumferential direction. The vacuum-cleaner-hose assembly has a tubular end portion 9, which in the coupled condition passes through the sealing diaphragm 64 and folds the segments 69 defined by the cuts 65 in the direction of flow through the inlet duct 63. A part 68 of the tubular end portion 9 which engages with the sealing diaphragm 64 in the coupled condition has such a cross-section that in the coupled condition a circumferentially uninterrupted part 70 of the sealing diaphragm 64, which part 70 adjoins the area defined by the outer ends 67 of the cuts 65, is extended in a circumferential direction and is in sealing engagement with the tubular end portion 9 of the vacuum-cleaner-hose assembly.

Since the sealing between the inlet duct 63 and the tubular end portion 9 of the vacuum-cleaner-hose assembly is provided by means of a annular area 70 of the diaphragm 64, which area adjoins the ends 67 of the cuts 65, no additional sealing lip is required upstream or downstream of the diaphragm 64. This enables a very simple flat sealing element to be used. A further advantage of the present seal is that a sealing element can be used of which, viewed in the flow direction, one side is identical to the other side, so that it is irrelevant which side of the sealing element faces the interior of the housing 4 during assembly.

The advantages of a sealing diaphragm as described hereinbefore can also be achieved when the sealing element is used in conjunction with other vacuum-cleaner-hose assemblies than described hereinbefore, for example in combination with vacuum-cleaner-hose assemblies comprising conventional swivel couplings which may be rotatable bodily relative to the vacuum cleaner, which may comprise a part which is rotatable relative to the vacuum cleaner and a part which is non-rotatable relative to the vacuum cleaner, or which may be adapted for non-rotatable mounting on a swiveling part of the vacuum cleaner. In each case it is important, however, that the tubular end portion, which need not be circular, has such a shape and size that in the coupled condition an uninterrupted slightly extended part of the diaphragm is in engagement with the tubular end portion.

The tubular end portion 9 has a tapered exterior, as a result of which the frictional resistance between the tubular end portion 9 and the segments 69 which spring back is low when the vacuum-cleaner-hose assembly is removed.

Uncoupling of the vacuum-cleaner-hose assembly is further facilitated by the fact that the tubular end portion 9, in the coupled condition of the vacuum-cleaner-hose assembly, extends less far into the inlet duct 63 than the folded diaphragm segments 69 defined by the cuts 65. For a satisfactory folding of the segments 69 when the tubular end portion 9 is passed through the diaphragm 64 it appears not to be necessary for the tubular end portion 9 to extend up to the free ends of the folded segments 69. Even when the tubular end portion 9 extends to less than halfway the segments 69 these segments are folded over to an adequate extent and the parts of the segments 69 which project beyond the tubular end portion 9 extend substantially in the longitudinal direction of the inlet duct 63, so that the air resistance produced by them is negligible.

What is claimed is:

1. A vacuum-cleaner-hose assembly comprising:

a vacuum-cleaner hose (6, 36);

a housing (4);

a swivel coupling (3, 33) for coupling the vacuum-cleaner hose to the housing (4) of a vacuum cleaner so as to allow swivelling about a swivel axis (5) and at an angle relative to said swivel axis (5); and an air channel (7, 37) extending through the vacuum-cleaner hose (6, 36) and the swivel coupling (3, 33), the swivel coupling (3, 33) comprising a hose guide (8, 38) which surrounds a flexible portion (24, 54) of the vacuum-cleaner hose (6, 36) and holds said portion of the vacuum-cleaner hose (6, 36) in a curved position.

2. A vacuum-cleaner-hose assembly as claimed in claim 1, wherein:

the swivel coupling (3, 33) further comprises a rotatable coupling part adapted to cooperate with a fixed coupling part; and the vacuum-cleaner hose (6, 36), at the side of said swivel coupling (3, 33), has an end which is coaxial with the swivel axis (5).

3. A vacuum-cleaner-hose assembly as claimed in claim 1, wherein the vacuum-cleaner hose (6) is rotatable about its longitudinal axis in the hose guide (8).

4. A vacuum-cleaner-hose assembly as claimed in claim 3, wherein the vacuum-cleaner hose (6) comprises a flexible portion (24) and a hose spigot (11) adjoining the flexible portion (24) at the side of the swivel coupling (3), and the joint between the flexible portion (24) of the vacuum-cleaner hose (6, 36) and the hose spigot (11) is oriented coaxially with the swivel axis (5).

5. A vacuum-cleaner-hose assembly as claimed in claim 1, wherein:

the vacuum-cleaner hose (36) comprises a flexible portion (54) and a hose spigot (41) adjoining the flexible portion (54) at the side of the swivel coupling (33); and the air channel (37) in the swivel coupling (33) takes a form of a bend, which extends partly in the hose spigot (41) and partly in said flexible portion (54) of the vacuum-cleaner hose (36), which portion is held in a curved condition.

6. A vacuum-cleaner-hose assembly as claimed in claim 1, wherein the swivel coupling (3, 33) comprises a hose-side first coupling part and a second coupling part, the first coupling part being rotatable relative to the second coupling part about the swivel axis (5) and the second coupling part being adapted to be coupled to a vacuum cleaner (4).

7. A vacuum-cleaner-hose assembly as claimed in claim 1, wherein the vacuum-cleaner hose (6, 36) comprises:

a flexible portion (24, 54) provided with at least one electrical conductor (25); and a hose spigot (11, 41) adjoining the flexible portion (24, 54) at the side of the swivel coupling (3, 33) and provided with at least one slip ring (26) or wiper contact connected to the electrical conductor (25).

8. A vacuum-cleaner-hose assembly as claimed in claim 6, wherein said hose spigot (11, 41) forms part of said hose-side first coupling part, and said second coupling part is provided with at least one wiper contact (27) or slip ring and at least one conductor (30) connected thereto.

9. A vacuum-cleaner-hose assembly as claimed in claim 6, wherein:

the vacuum-cleaner hose (6, 36) is provided with at least one electrical conductor (25);

said first coupling part is provided with at least one slip ring (26);

said second coupling part is provided with at least one wiper contact (27), which cooperates with said slip ring (26); and at least one contact pin (29) or contact spring for cooperation with at least one contact spring or contact pin, respectively, of the vacuum cleaner (4), each contact pin (29) or contact spring of said second coupling part having an arm (28) which extends up to a location opposite a contact face of the slip ring or at least one of (26).

10. A vacuum-cleaner-hose assembly as claimed in claim 6, wherein:

the vacuum-cleaner hose (6, 36) is provided with at least one electrical conductor (25);

said first and said second coupling part are electrically coupled by at least one slip ring (26) and a wiper contact (27) which cooperates with said slip ring;

said second coupling part is provided with at least one contact pin (29) or contact spring for cooperation with at least one contact spring or contact pin, of the vacuum cleaner (4), each slip ring (26) and each contact pin (29) or contact spring being mounted in a corresponding mounting position; and the number of mounting positions adapted to receive a contact pin (29) or contact spring, being greater than the number of mounting positions for the slip rings (26).

11. A vacuum-cleaner-hose assembly as claimed in claim 1, wherein:

the vacuum-cleaner hose (6, 36) is provided with electrical conductors (25);

the swivel coupling (3, 33) comprises a hose-side first coupling part and a second coupling part, the first coupling part being rotatable relative to the second coupling part about the swivel axis (5), the swivel coupling (3, 33) being provided with cooperating wiper contacts (27), which are connected to the electrical conductor (25), and mutually coaxial slip rings (26); and the wiper contacts (27) each project from arms (28) of a conductive material towards a respective one of the slip rings (26), which arms extend transversely to the slip rings (26) and along these slip rings (26).

12. A vacuum-cleaner-hose assembly as claimed in claim 10, wherein the wiper contacts (27) are each arranged on one of said arms (28) in a position corresponding to the position of the respective slip ring (26) and said arms (28) being identical to one another.

13. A vacuum-cleaner-hose assembly as claimed in claim 2, wherein the vacuum-cleaner hose (6) is rotatable about its longitudinal axis in the hose guide (8).

14. A vacuum-cleaner-hose assembly as claimed in claim 2, wherein:

the vacuum-cleaner hose (36) comprises a flexible portion (54) and a hose spigot (41) adjoining the flexible portion (54) at the side of the swivel coupling (33); and the air channel (37) in the swivel coupling (33) takes a form of a bend, which extends partly in the hose spigot (41) and partly in said flexible portion (54) of the vacuum-cleaner hose (36), which portion is held in a curved condition.

15. A vacuum-cleaner-hose assembly as claimed in claim 1, wherein: the swivel coupling (3, 33) comprises a hose-side first coupling part and a second coupling part, the first coupling part being rotatable relative to the second coupling part about the swivel axis (5) and the second coupling part being adapted to be coupled to a vacuum cleaner (4).

16. A vacuum cleaner comprising:

a cleaning the; and a vacuum-cleaner-hose assembly comprising:

a vacuum-cleaner hose (6, 36);

a swivel coupling (3, 33) by which the vacuum-cleaner-hose assembly can be coupled to a housing (4) of the vacuum cleaner so as to allow it to be swivelled about a swivel axis (5) and at an angle relative to said swivel axis (5); and an air channel (7, 37) extending through the vacuum-cleaner hose (6, 36) and the swivel coupling (3, 33).

the swivel coupling (3, 33) comprising a hose guide which surrounds a flexible portion (24, 54) of the vacuum cleaner hose (6, 36) and holds said portion of the vacuum-cleaner hose (6, 36) in a curved position.

17. A vacuum cleaner as claimed in claim 16, further comprising:

an inlet duct (63) for connection of the vacuum-cleaner-hose assembly (2); and a sealing diaphragm (64) in the inlet duct (63) for at least substantially closing the inlet duct (63) when the vacuum-cleaner-hose assembly of the vacuum cleaner (4) is in the uncoupled condition and for opening the inlet duct (63) when the vacuum-cleaner-hose assembly has been coupled to the vacuum cleaner (4).

the sealing diaphragm (64) having cuts (65) which, when the vacuum-cleaner-hose assembly has been uncoupled, each extend from a central area (66) of the diaphragm (64) to a point near the wall of the inlet duct (63) and whose outer ends (67) are equispaced in the circumferential direction.

the vacuum-cleaner-hose assembly having a tubular end portion (9), which in the coupled conditions passes through the sealing diaphragm (64) and folds the segments (69) defined by the cuts (65) in the direction of flow through the inlet duct (63), and a part (68) of the tubular end portion (9), which part engages with the sealing diaphragm (64) in the coupled condition, having such a cross-section that in the coupled condition a circumferentially uninterrupted part (70) of the sealing diaphragm (64), which part (70) adjoins the area defined by the outer ends (67) of the cuts (65), is extended in a circumferential direction and is in sealing engagement with the tubular end portion (9) of the vacuum-cleaner-hose assembly (2).

18. A vacuum cleaner as claimed in claim 17, wherein the tubular end portion (9) has a tapered exterior.

19. A vacuum cleaner as claimed in claim 17, wherein the tubular end portion (9), in the coupled condition of the vacuum-cleaner-hose assembly (2), extends less far into the inlet duct (63) than the folded segments (69) of the diaphragm (64) which are defined by the cuts.

* * * * *